US007617565B2

(12) United States Patent
Mersmann et al.

(10) Patent No.: US 7,617,565 B2
(45) Date of Patent: Nov. 17, 2009

(54) HOUSING FOR A CYLINDER VACUUM CLEANER

(75) Inventors: Udo Mersmann, Guetersloh (DE); Arne Sauerland, Herford (DE)

(73) Assignee: Miele & Cie. KG, Guetersloh (DE)

( * ) Notice: Subject to any disclaimer, the term of this patent is extended or adjusted under 35 U.S.C. 154(b) by 384 days.

(21) Appl. No.: 11/569,272

(22) PCT Filed: Apr. 14, 2005

(86) PCT No.: PCT/EP2005/003910

§ 371 (c)(1),
(2), (4) Date: Nov. 17, 2006

(87) PCT Pub. No.: WO2005/112726

PCT Pub. Date: Dec. 1, 2005

(65) Prior Publication Data

US 2007/0209153 A1 Sep. 13, 2007

(30) Foreign Application Priority Data

May 17, 2004 (DE) ..... 10 2004 024 817

(51) Int. Cl.
*A47L 5/00* (2006.01)

(52) U.S. Cl. ..... 15/327.2; 15/412; 15/347

(58) Field of Classification Search ..... 15/327.1, 15/327.2, 327.7, 347, 412
See application file for complete search history.

(56) References Cited

U.S. PATENT DOCUMENTS

| | | | | |
|---|---|---|---|---|
| 3,651,536 | A | 3/1972 | Bolzan, Jr. et al. | |
| 3,781,460 | A | 12/1973 | Westergren et al. | |
| 4,864,683 | A * | 9/1989 | Herron et al. | 15/412 |
| 7,140,067 | B2 * | 11/2006 | Albert et al. | 15/327.2 |
| 7,367,084 | B2 * | 5/2008 | Schwarz et al. | 15/327.1 |
| 2005/0138758 | A1 * | 6/2005 | Lee et al. | 15/327.2 |
| 2007/0220699 | A1 | 9/2007 | Mersmann et al. | |

FOREIGN PATENT DOCUMENTS

| | | |
|---|---|---|
| DE | 84 32 010 | 2/1985 |
| DE | 4112635 | 10/1992 |
| DE | 93 12 061 | 11/1993 |
| DE | 44 21 214 | 12/1995 |
| DE | 44 21 458 | 12/1995 |
| JP | 03077514 | 4/1991 |
| JP | 11 089771 | 4/1999 |
| JP | 2003 204941 | 7/2003 |
| NL | 1022340 | 4/2003 |
| WO | WO 02/051296 | 7/2002 |
| WO | WO 03/028517 | 4/2003 |

* cited by examiner

*Primary Examiner*—Dung Van Nguyen
(74) *Attorney, Agent, or Firm*—Darby & Darby

(57) ABSTRACT

An appliance housing for a canister vacuum cleaner having an interior divided into a motor fan chamber and a dust collection chamber includes a flat, upwardly open receiving shell. The receiving shell has a partition dividing the lower housing part into a first bottom portion for the motor fan chamber and a second bottom portion for the dust collection chamber. The second bottom portion includes a surrounding seal portion. An upper housing part in provided including an upwardly and downwardly open, substantially tubular housing insert defining the dust collection chamber. A lower edge of the housing insert is receivable in the surrounding seal portion of the second bottom portion of the lower housing part. A housing cover closes the dust collection chamber.

20 Claims, 6 Drawing Sheets

HOUSING FOR A CYLINDER VACUUM CLEANER

CROSS REFERENCE TO PRIOR APPLICATION

This is a U.S. national phase application under 35 U.S.C. §371 of International Patent Application No. PCT/EP2005/003910, filed Apr. 14, 2005, and claims benefit of German Patent Application No. 10 2004 024 817.6, filed May 17, 2004, which is incorporated by reference herein. The International Application was published in German on Dec. 1, 2005 as WO 2005/112726 A1 under PCT Article 21(2).

The present invention relates to an appliance housing for a canister vacuum cleaner, whose interior is divided into a motor fan chamber and a dust collection chamber and which includes a lower housing part, an upper housing part, and a housing cover, the dust collection chamber being closable by the housing cover.

BACKGROUND

A vacuum cleaner having a multi-part appliance housing which is formed by a lower housing part and an upper housing part is described in DE 44 21 214 A1. The upper housing part includes one or more separate cover parts. The lower housing part is divided by a partition into a motor fan chamber and a dust collection chamber.

Document DE 44 21 458 C2 describes a vacuum cleaner having a multi-part appliance housing where a housing cover pivotally mounted on cover hinges covers the dust collection chamber for a dust filter bag, and a replaceable exhaust or hygiene filter. The housing cover is hinged to the upper housing part which covers the motor fan chamber. When closed, the cover is flush with the upper housing surface in this area.

In both designs, the multi-part construction of the housing is configured such that the lower housing part is formed as a shell having raised side walls and including a motor fan chamber which is sealed off from the dust collection chamber. The motor fan chamber is covered by the upper housing part to which the housing cover is hinged. The housing cover is shaped such that it forms the upper housing surface and the lateral wall for the dust collection chamber. Furthermore, the housing cover has a storage compartment for vacuum cleaner accessories, said storage compartment being closable by a separate cover. The exhaust air of the vacuum cleaner is passed from the motor fan chamber through an exhaust filter. The exhaust filter is disposed below the housing cover. The housing cover has exhaust slots formed in the area covering the exhaust filter.

Due to the construction and arrangement of the cover, both designs place increased demands on the design of the seals in order for the negative pressure area in the dust collection chamber to be optimally sealed off from the exhaust or positive pressure area of the motor fan chamber. The pronounced dome shape of the housing cover, which also forms the lateral housing boundary of the dust collection chamber, is very complex to manufacture. Moreover, when the housing cover is open, the impression of an unstable configuration arises.

In order to avoid these drawbacks, modified constructions have been described for canister vacuum cleaners (for example, Miele S 700 series), where the multi-part appliance housing features a lower part having lateral walls that are raised in the shape of a pot to provide the boundary of the dust collection chamber. The pot-shaped, raised walls of the dust collection chamber are provided with a peripheral seal which sealingly abuts the housing cover portion for the dust collection chamber. The pot-shaped, raised walls of the dust collection chamber are laterally covered by an upper housing part enclosing the motor fan chamber and the dust collection chamber. A flat housing cover having a storage compartment for vacuum cleaner accessories is hinged to the housing portion that covers the motor fan chamber. The upper housing part portion enclosing the motor fan chamber has a seat for an exhaust filter. Also disposed on this housing portion are the ON/OFF button, the control elements for the suction power control, and the cord winder button.

The lower part including the lateral dust collection chamber walls, which are raised in the shape of a pot, is complex to manufacture in terms of tools, requiring large expensive injection molding machines. Moreover, unfavorable wall thickness ratios may result in sink marks in the transition region from the bottom plate to the raised lateral wall portions and the ribs formed thereon.

Furthermore, due to the increase in suction power, it has now become necessary to reinforce the walls of the dust collection chamber with ribs (see DE 93 12 061, FIG. 1). In the above-described constructions, where the ribs of the dust collection chamber bottom are formed from the lower housing part, this results in sink marks on the exposed outer side of the housing. It is therefore known to form the dust collection chamber as a separate insert (DE 84 32 010 U1), or to form a downwardly open insert on the upper housing part. In this manner, a double bottom is formed, which reduces the space available in the dust collection chamber, and thus the dust collection capacity. Since in all of the above-described variants, the side walls and bottom of the dust collection chamber form a closed pot, the molds forming the lateral ribs must be removed upwardly. This results in the requirement of using straight-surfaced, uncurved dust collection chamber walls having an exterior edge, the ribs extending into the opening of the dust collection chamber thus reducing the size thereof.

SUMMARY

It is, therefore, an object of the present invention to provide a multi-part rigid construction which is suitable for the appliance housing of a vacuum cleaner and cost-effective to manufacture, in which the dust collection chamber is designed to have the maximum possible volume, and whose negative pressure area in the dust collection chamber can be optimally sealed off from the motor fan chamber despite having a maximum bag volume.

In an embodiment, the present invention provides appliance housing for a canister vacuum cleaner having an interior divided into a motor fan chamber and a dust collection chamber. The appliance housing includes: a lower housing part including a flat, upwardly open receiving shell having a partition dividing the lower housing part into a first bottom portion for the motor fan chamber and a second bottom portion for the dust collection chamber, the second bottom portion including a surrounding seal portion; an upper housing part including an upwardly and downwardly open, substantially tubular housing insert defining the dust collection chamber, a lower edge of the housing insert being receivable in the surrounding seal portion of the second bottom portion of the lower housing part; and a housing cover configured for closing the dust collection chamber.

BRIEF DESCRIPTION OF THE DRAWINGS

Exemplary embodiments of the present invention are shown in the drawings in a schematic way and will be described in more detail below. In the drawings.

DETAILED DESCRIPTION

Figure 1:
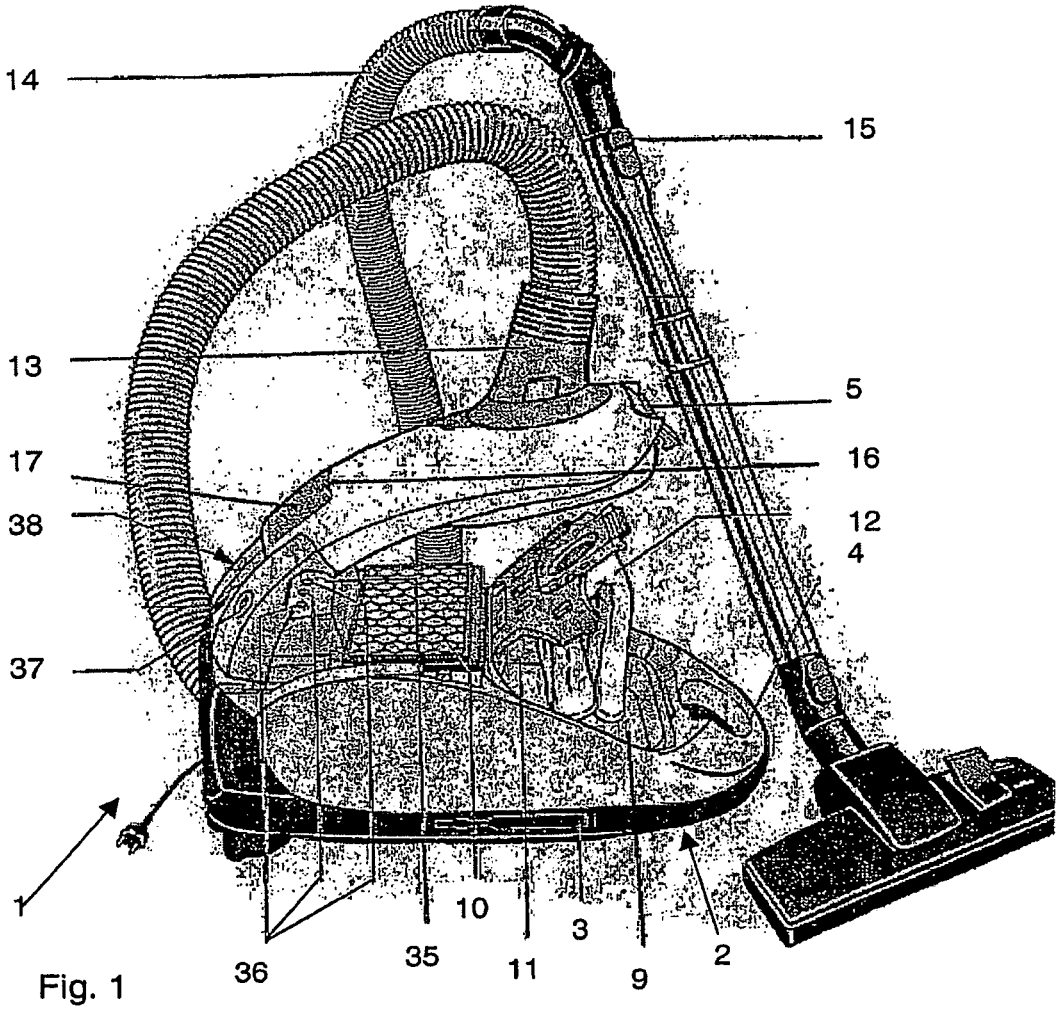
FIG. 1 shows a first exemplary embodiment of a canister vacuum cleaner 1 with housing cover 5 open.

One particular advantage that can be achieved with the present invention is that the shape of the individual housing parts allows these parts to be produced in injection molds and injection molding machines that are relatively cost-effective to manufacture, because the shape of said housing parts is adapted to optimum ejection systems, and because the individual parts have a low weight and a small projected surface area. Furthermore, the low material usage for the individual parts allows for shorter cycle times during injection molding, which overall makes the parts more cost-effective to produce. Due to the upwardly and downwardly open, substantially tubular construction of the housing insert, said housing insert can be removed from the mold in a downward direction, thus providing better, space-saving possibilities for the design of inner ribs and sealing surfaces.

In an advantageous embodiment, the housing insert is designed as a separate component without any exposed housing surfaces. This provides for color variant-free manufacture, which simplifies warehousing and handling during assembly. In addition, such an insert allows for any desired rib pattern to be formed on the outer side. Thus, in case of very high suction powers, the housing insert may advantageously be reinforced with a framework-like rib structure on the outwardly facing surface.

In order to simplify assembly, it is useful if the tubular portion of the housing insert has formed thereon an insert section which covers the motor fan chamber and is downwardly open and upwardly closed except for an exhaust port. Moreover, for visual design reasons, it is convenient if the housing insert is encased by the upper housing part, which is in the form of a cover frame.

Another advantageous embodiment, especially for somewhat lower suction powers, is characterized in that the upper housing part is double-walled and that the inner wall forms the housing insert. This provides a simple construction which is easy to manufacture. In order to further simplify manufacture, it is convenient if the upper housing part includes a rear housing section which covers the motor fan chamber and is substantially closed upwardly.

It is also advantageous if vertical outer ribs extending in the axial direction of the housing insert are arranged between the inner walls forming the housing insert and outer walls of the upper housing part which form the exposed housing surfaces. In this manner, adequate reinforcement of the dust collection chamber can also be achieved by a simple rib construction which is easy to remove from the mold.

Due to the downwardly open configuration of the housing insert, the housing insert can be provided on the inwardly facing surface with inner ribs which extend in the axial direction and toward the interior of the dust collection chamber and are readily removed from the mold in a downward direction. Because the housing insert can be removed downwardly from the mold, it may be curved or angled inwardly in the area of the opening facing the housing cover, and the inner ribs may be at least partially located below the curved or angled portion with respect to their extent in the direction of the interior of the dust collection chamber. The angle or curvature of the housing insert makes it possible to conform the housing insert very closely to the outer sides of the upper housing part and/or the covering, and thus, to use the available volume nearly entirely as a dust collection chamber. It is because the housing insert can be removed downwardly from the mold, i.e., through the bottom opening, that the housing insert may be provided with such an angle or curvature and yet be equipped with ribs.

FIG. 1 shows a canister vacuum cleaner 1 having a multi-part appliance housing 2. Appliance housing 2 includes a flat lower housing part 3 and a downwardly open upper housing part 4 placed thereon. Housing cover 5 is pivotally mounted to upper housing part 4 using two hinge arms 6 (see FIG. 2) in the rear portion of cover 5. When closed, this cover covers motor fan chamber 7 (see FIG. 2) and closes dust collection chamber 9 (see also FIGS. 3 and 4). The upper housing part has formed therein an exhaust port 8 for the exhaust air from motor fan chamber 7, a replaceable exhaust or hygiene filter 10 being insertable into said exhaust port. Dust collection chamber 9 is upwardly open and is provided with a mount 11 for a dust bag 12. Mount 11 is pivotally supported in dust collection chamber 9 and has the same pivoting direction as housing cover 5. Located on housing cover 5 is an adapter 13 for a suction hose 14 which, in the exemplary embodiment shown, has a telescopic wand 15. An outlet 16 for the filtered exhaust air (see also FIG. 2) is formed in housing cover 5 in the area where it covers exhaust port 8 or exhaust or hygiene filter 10. Outlet 16 may be formed by air slots (not shown) in housing cover 5 or be provided with an insertable air grille 17 which is flush with the upper surface of housing cover 5.

Figure 2:
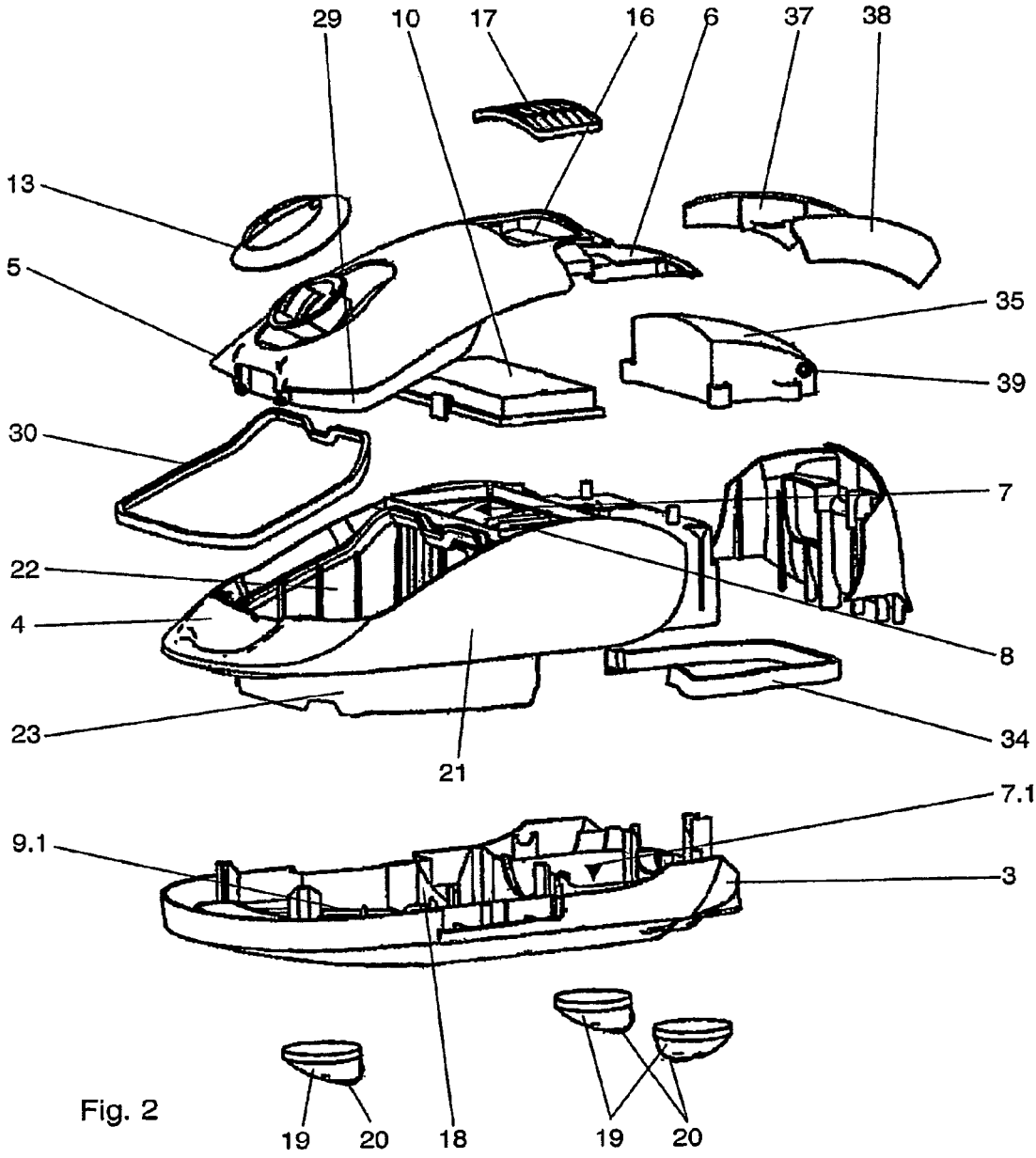
FIG. 2 is an exploded view of multi-part appliance housing 2 of canister vacuum cleaner 1 of FIG. 1.
Figure 3:
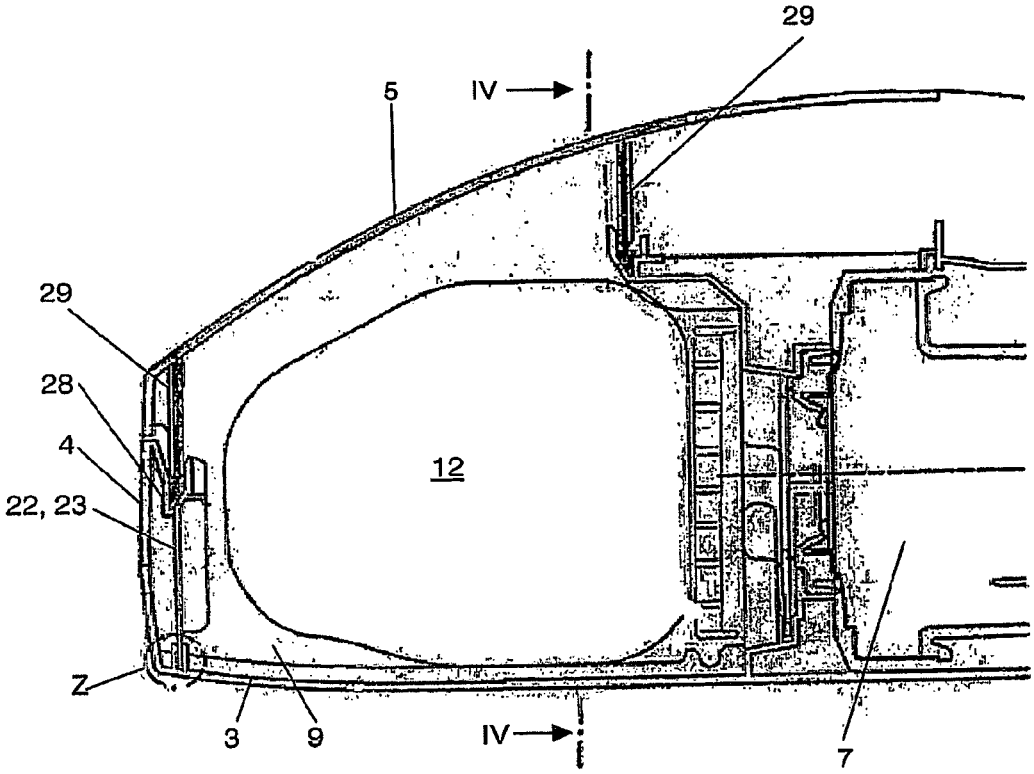
FIG. 3 is a cross-sectional side view of dust collection chamber 9 of canister vacuum cleaner 1 of FIG. 1 and dust bag 12.
Figure 4:
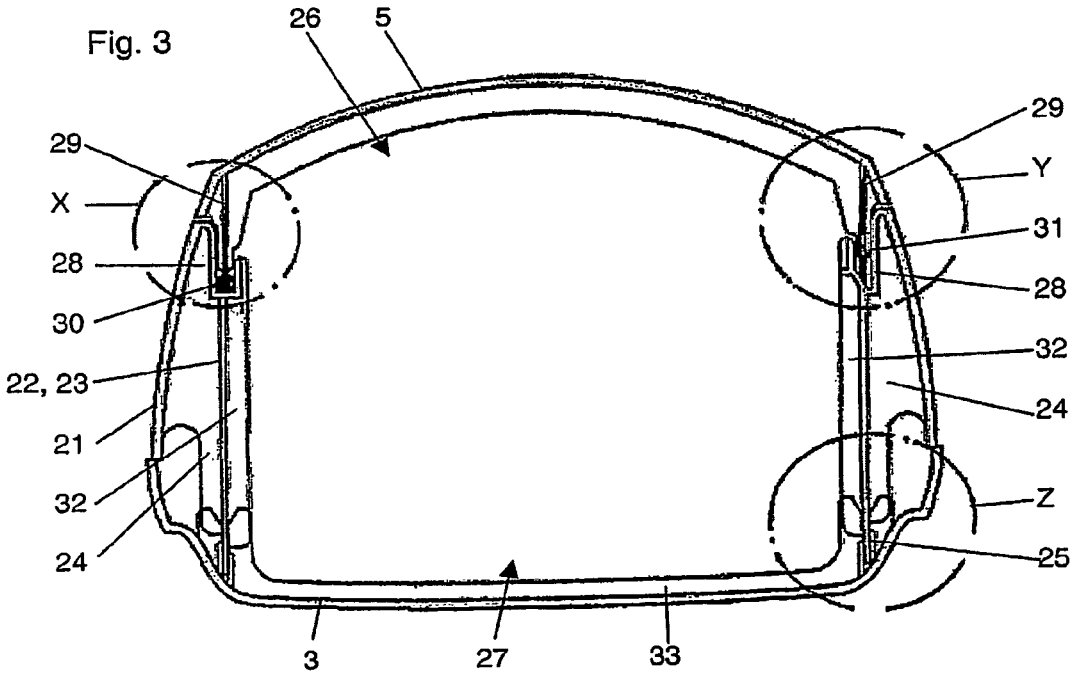
FIG. 4 is a cross-sectional view (taken along line IV-IV) showing dust collection chamber 9 of FIG. 3 without the dust bag.

The structural design of the appliance housing is illustrated in greater detail in an exploded view in FIG. 2 and in the cross-sectional views of FIG. 3 (longitudinal section) and FIG. 4 (lateral section). All housing parts are injection molded from plastic. Lower housing part 3 is configured as a flat, upwardly open receiving shell having a partition 18 that divides the bottom portion 7.1 for motor fan chamber 7 from the bottom portion 9.1 for dust collection chamber 9. Rotating skids 19 having rollers 20 are inserted at the bottom of lower housing part 3.

Figure 7:
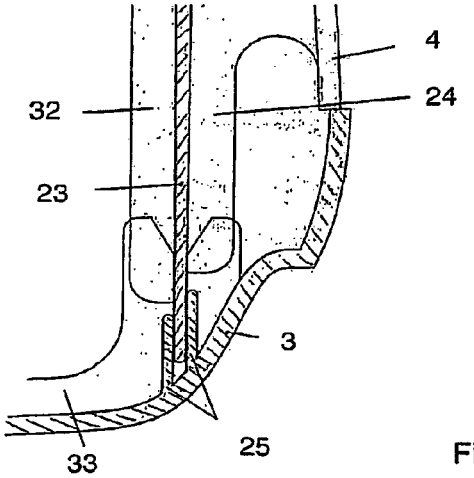
FIG. 7 shows the seating of housing insert 23 in U-section 25 which is located on lower housing part 3 and surrounds bottom 9.1 of dust collection chamber 9 (detail Z)

The assembly including lower housing part 3 and upper housing part 4 forms motor fan chamber 7 and dust collection chamber 9. In order for dust collection chamber 9 to withstand the negative pressure generated by the motor fan (not shown) during vacuum cleaning when housing cover 5 is closed, upper housing part 4 is double walled in the front portion. Outer walls 21 form the exposed housing surfaces and inner walls 22 form a downwardly and upwardly open, substantially tubular housing insert 23, which in turn forms the lateral walls of dust collection chamber 9. Vertical outer ribs 24 extending in the axial direction of the housing insert are arranged between inner walls 22 and outer walls 21. Inner walls 22, and thus the edge of lower opening 27 of housing insert 23, are surrounded by a peripheral seal which is located in the housing bottom and preferably takes the form of a U-section 25. In this manner, dust collection chamber 9 is hermetically sealed downwardly. In the cross-sectional views of FIGS. 3 and 4, the position of the peripheral seal arrangement is designated as detail "Z", which is shown enlarged in FIG. 7. In the exemplary embodiment shown, pressure-tight assembly of the upper housing part and the lower housing part in the area of the dust collection chamber is achieved by the structural design and the matching of sealing surface tolerances alone. However, it is also possible to provide additional sealing material.

Figures 5A, 5B:
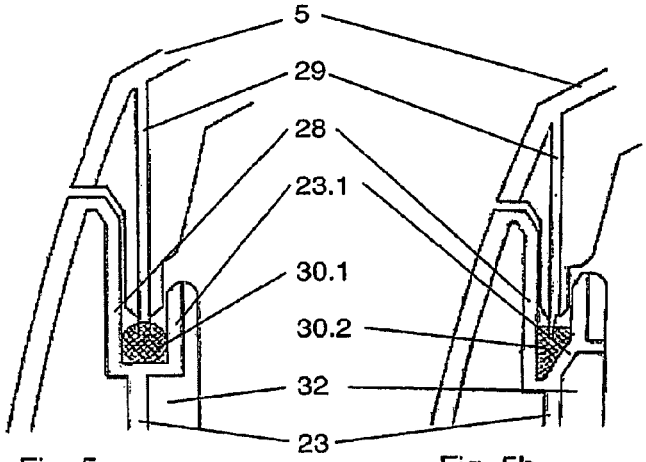
FIG. 5*a* through *c* shows first variants 30.1, 30.2 and 30.3 of a dust collection chamber seal including a seal 30 on housing insert 23 (detail X)
Figure 5C:
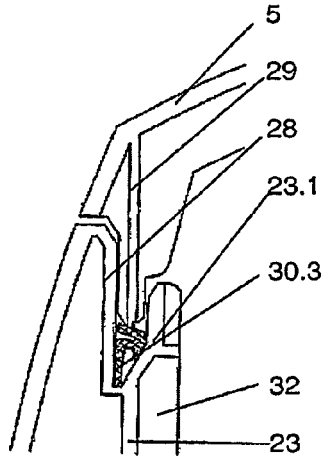
Figures 6A, 6B:
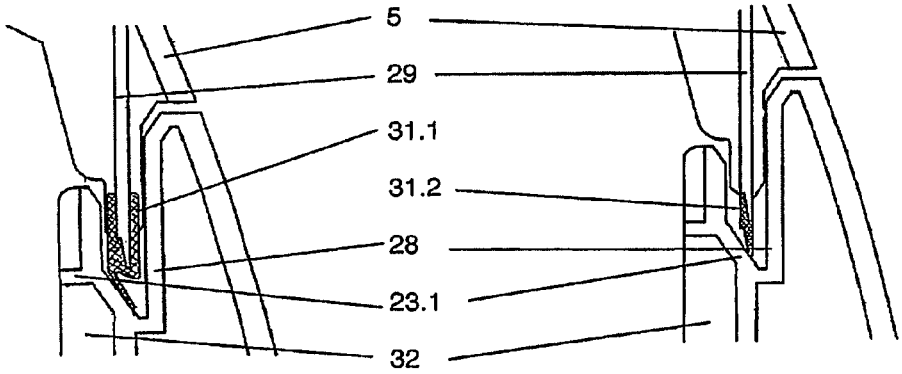
FIGS. 6*a, b* shows second variants 31.1 and 31.2 of a dust collection chamber seal including a seal 31 on housing cover 5 (detail Y)

Upper opening 26 of housing insert 23 is closed by housing cover 5. Housing insert 23 has a U- or V-shaped groove 28 surrounding the upper edge of the dust collection chamber. Housing cover 5 is provided with a mating part in the portion closing dust collection chamber 9 or housing insert 23, said mating part being in the form of a peripheral vertical wall section 29 which is inserted into groove 28 and seals dust collection chamber 9 in a pressure-tight manner during vacuum cleaning when housing cover 5 is closed (see FIG. 2 and FIG. 3). FIG. 4 shows in a cross-sectional view two possible variants of seal arrangements that provide a pressure-tight seal. Detail "X" illustrates a variant in which a seal 30 is disposed in groove 28. In FIGS. 5*a* through 5*c*, various embodiments 30.1, 30.2 and 30.3 of this seal 30 are shown in an enlarged view. In the variant according to detail "Y", a seal 31 is disposed on vertical wall section 29 of housing cover 5, for example, by injection molding around this section 29 using a 2 k method. Two variants 31.1 and 31.2 are illustrated in an enlarged view in FIGS. 6*a* and 6*b*.

Further reinforcement of the dust collection chamber is provided by inner ribs 32, which are disposed on the inwardly facing surface of housing insert 23 and extend in an axial direction and toward the interior of the dust collection chamber. These inner ribs 32 are at least partially (FIG. 5*a*) or completely (FIGS. 5*b*, 5*c*, 6*a*, and 6*b*) located below the angled portion 23.1 of housing insert 23 with respect to their extent in the direction of the interior of the dust collection chamber, said angled portion being formed by the inwardly directed leg of groove 28. The inner side of dust collection chamber bottom 9.1 may also be provided with a rib structure 33.

In the area of motor fan chamber 7, upper housing part 4 is substantially closed upwardly, except for the outlet for the exhaust air (exhaust port 8), and is open downwardly. Upper housing part 4 covers the motor and the fan (both not shown) and, together with the bottom portion and a profiled seal 34 placed therebetween, forms motor fan chamber 7, which, during vacuum cleaning, is subjected to a pressure higher than that of the ambient air.

Attached to the upper side of the upper housing part is a separate covering 35 which accommodates the switching elements (not shown) of the ON/OFF switch and of the suction power control, and which carries on its upper surface the control elements 36 for the suction power control. Moreover, covering 35 is provided with a through-hole for a switch plunger (not shown), which serves as an actuator for a cord winder device. The actuating buttons 37 for the switch plunger and 38 for the ON/OFF switch are mounted on hinge arms 6 of housing cover 5 in such a manner that they can be pivoted against a spring force.

Housing cover 5 is mounted, via its hinge arms 6, laterally on covering 35 in a hinge bearing 39. When the housing cover is closed, the upper side of covering 35 closes flush with the actuating buttons.

Figure 8:
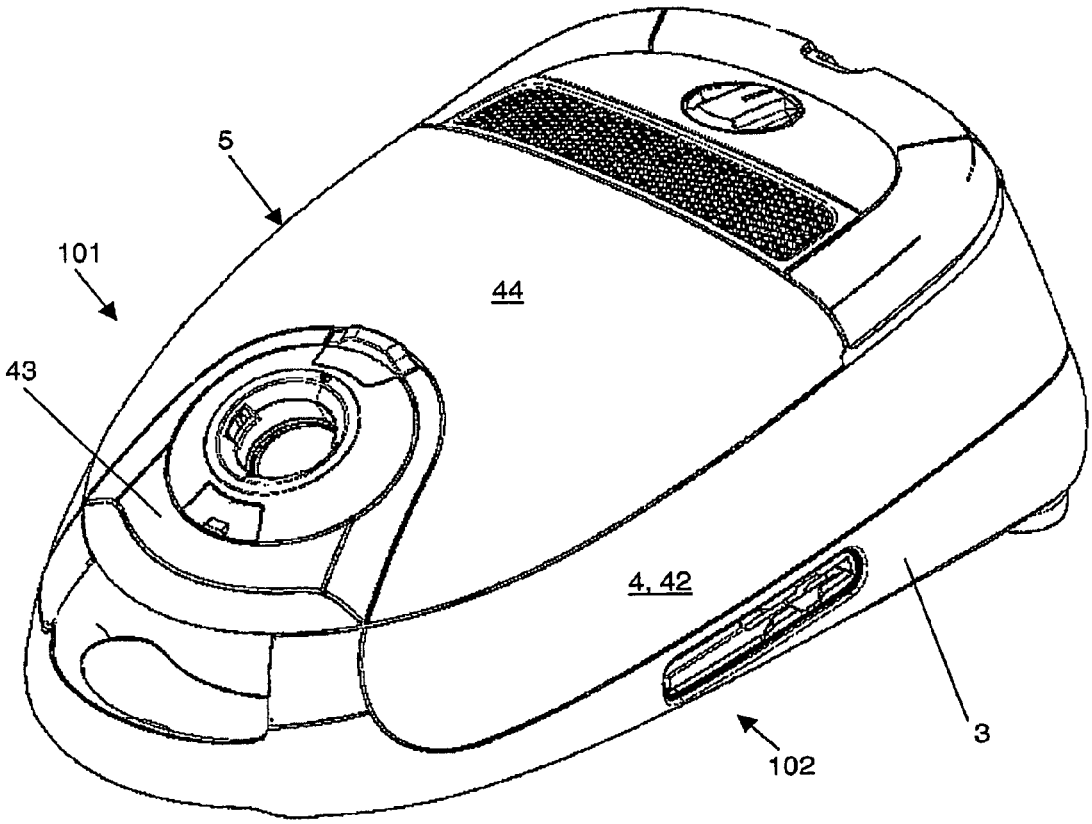
FIG. 8 is a perspective view showing a second exemplary embodiment of a canister vacuum cleaner 101.
Figure 9:
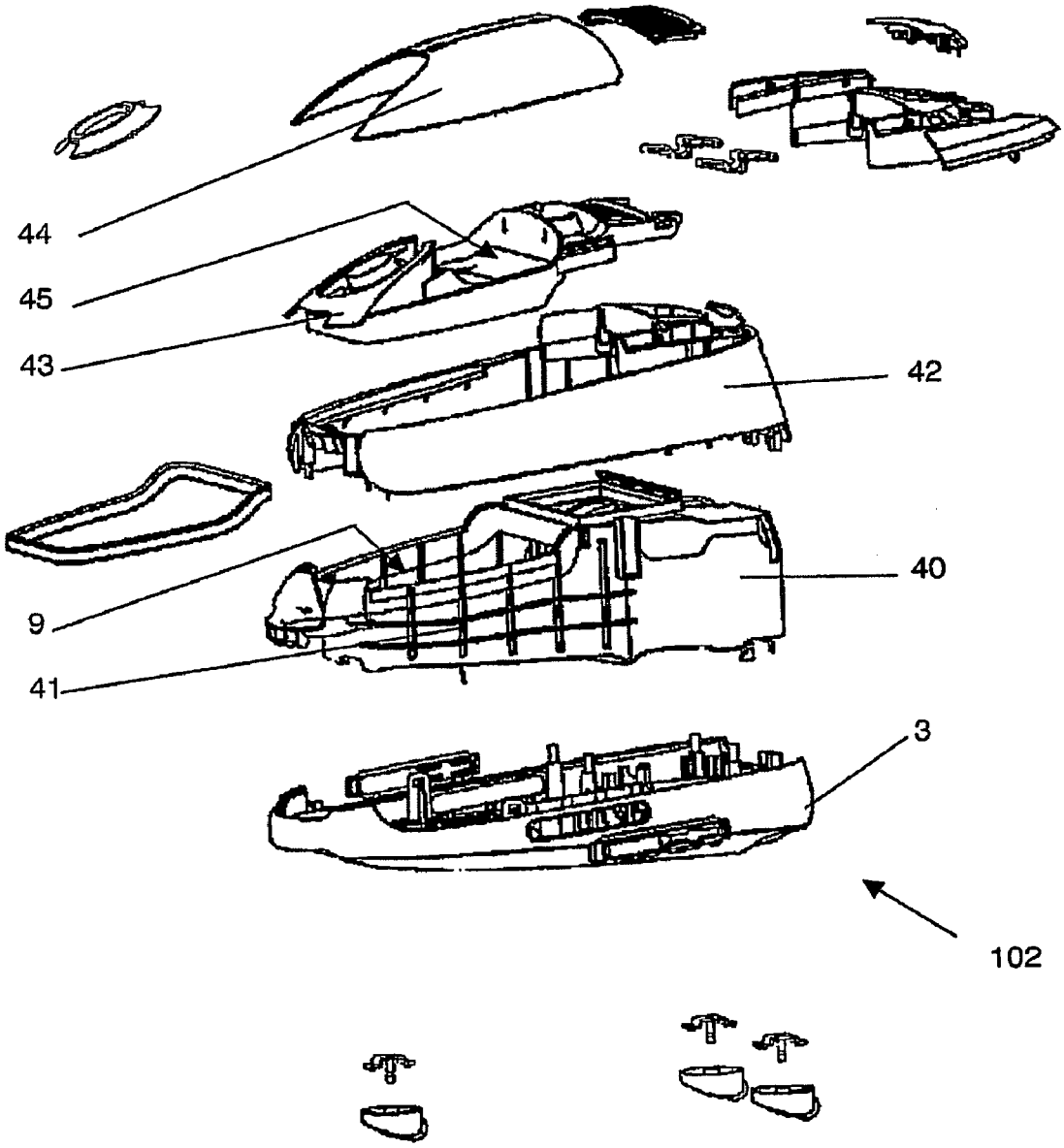
FIG. 9 is an exploded view of multi-part appliance housing 201 of the canister vacuum cleaner 101 of FIG. 8.

FIGS. 8 and 9 illustrate a canister vacuum cleaner 101 having an appliance housing 102, in which the dust collection chamber is formed using a housing insert 40 (see FIG. 9) which is designed as a separate component without any exposed housing surfaces. This makes it possible to attach a framework-like rib structure 41 on the outer side thereof, said framework-like rib structure further reinforcing the dust collection chamber 9, thus making it suitable for use with fans of very high suction power. Housing insert 40 is encased by upper housing part 4, which here is in the form of a cover frame 42. In the exemplary embodiment shown, housing cover 5 is of two-part construction. A first cover 43 is pivotally mounted on upper housing part 5 and serves to close dust collection chamber 9. A second cover 44 is pivotally mounted on the first one and closes an accessory compartment 45 which is integrated in the first cover. The sealing of dust collection chamber 9 to housing bottom 3 and first cover 43 is accomplished analogously to the exemplary embodiment described above.

The present invention is not limited to the exemplary embodiments described herein; reference should be had to the appended claims.

What is claimed is:

1. An appliance housing for a canister vacuum cleaner having an interior divided into a motor fan chamber and a dust collection chamber, the appliance housing comprising:

a lower housing part including a flat, upwardly open receiving shell having a partition dividing the lower housing part into a first bottom portion for the motor fan chamber and a second bottom portion for the dust collection chamber, the second bottom portion including a surrounding seal portion;

an upper housing part including an upwardly and downwardly open, substantially tubular housing insert defining the dust collection chamber, a lower edge of the housing insert being receivable in the surrounding seal portion of the second bottom portion of the lower housing part; and a housing cover configured for closing the dust collection chamber.

2. The appliance housing as recited in claim 1 wherein the upper housing part includes an inner and an outer wall, the inner wall forming the housing insert.

3. The appliance housing as recited in claim 2 wherein the upper housing part includes a rear housing section covering the motor fan chamber, the rear housing section being substantially closed upwardly.

4. The appliance housing as recited in claim 3 wherein the outer wall forms an exposed housing surface, and wherein the upper housing part includes a vertical outer rib extending in an axial direction of the housing insert and disposed between the inner wall and the outer wall.

5. The appliance housing as recited in claim 2 wherein the outer wall forms an exposed housing surface, and wherein the upper housing part includes a vertical outer rib extending in an axial direction of the housing insert and disposed between inner and outer walls.

6. The appliance housing as recited in claim 1 wherein the housing insert includes an inner rib disposed on an inwardly facing surface thereof and extending in an axial direction of the housing insert toward an interior of the dust collection chamber.

7. The appliance housing as recited in claim 6 wherein:

the housing insert includes a first opening facing the housing cover;

the housing insert includes a first portion curved or angled inwardly in an area of the first opening; and at least a second portion of the inner rib is disposed below the first portion of the housing insert in the axial direction.

8. The appliance housing as recited in claim 1 wherein at least one of a housing section of the housing insert and another section of the upper housing part covers the motor fan chamber and includes an exhaust port for exhaust air from the motor fan chamber.

9. The appliance housing as recited in claim 1 wherein the upper housing part includes an exhaust port, and wherein the housing cover is pivotally mounted in the rear portion of the upper housing part via hinge arms and covers the motor fan chamber at least in an area of the exhaust port.

10. The appliance housing as recited in claim 1 wherein the housing insert includes a vertical wall section, and wherein the seal portion includes a U-section configured to sealingly receive the vertical wall section of the housing insert.

11. The appliance housing as recited in claim 1 wherein the housing insert includes an upper opening and includes a groove surrounding an edge of the upper opening, the groove being configured to receive a sealing material.

12. The appliance housing as recited in claim 11 wherein the sealing material forms a seal when received in the groove.

13. The appliance housing as recited in claim 11 wherein the sealing material is disposed on the housing cover so as to be received in the groove when the housing cover is in a closed position.

14. An appliance housing for a canister vacuum cleaner having an interior divided into a motor fan chamber and a dust collection chamber, the appliance housing comprising:

a lower housing part including a flat, upwardly open receiving shell having a partition dividing the lower housing part into a first bottom portion for the motor fan chamber and a second bottom portion for the dust collection chamber, the second bottom portion including a surrounding seal portion;

an upper housing part;

an upwardly and downwardly open, substantially tubular housing insert defining the dust collection chamber, a lower edge of the housing insert being receivable in the surrounding seal portion of the second bottom portion of the lower housing part; and a housing cover configured for closing the dust collection chamber.

15. The appliance housing as recited in claim 14 wherein the housing insert forms no exposed outer surface of the housing.

16. The appliance housing as recited in claim 15 wherein the housing insert includes a reinforcing framework-like rib structure disposed on an outwardly facing surface thereof.

17. The appliance housing as recited in claim 16 wherein the housing insert includes an insert section covering the motor fan chamber, the insert section being downwardly open and upwardly closed except for an exhaust port.

18. The appliance housing as recited in claim 16 wherein the housing insert is receivable in the upper housing part, the upper housing part having a form of a cover frame.

19. The appliance housing as recited in claim 15 wherein the housing insert includes an insert section covering the motor fan chamber, the insert section being downwardly open and upwardly closed except for an exhaust port.

20. The appliance housing as recited in claim 15 wherein the housing insert is receivable is the upper housing part, the upper housing part having a form of a cover frame.

* * * * *